US007059693B2

(12) United States Patent
Park

(10) Patent No.: US 7,059,693 B2
(45) Date of Patent: Jun. 13, 2006

(54) REFRIGERATOR

(75) Inventor: Yong-Pil Park, Suwon (KR)

(73) Assignee: Samsung Electronics Co., LTD, Suwon-si (KR)

( * ) Notice: Subject to any disclaimer, the term of this patent is extended or adjusted under 35 U.S.C. 154(b) by 270 days.

(21) Appl. No.: 10/626,622

(22) Filed: Jul. 25, 2003

(65) Prior Publication Data

US 2004/0148958 A1 Aug. 5, 2004

(30) Foreign Application Priority Data

Nov. 27, 2002 (KR) ..... 10-2002-0074404

(51) Int. Cl.
*F26D 23/02* (2006.01)

(52) U.S. Cl. ..... 312/405.1; 49/63; 312/321.5

(58) Field of Classification Search ..... 312/405.1, 312/404, 405, 291, 292, 327, 328, 319.2, 312/321.5, 402; 49/61, 63, 142, 143, 386; 62/265, 441; 292/175, 341.15, 302, DIG. 4; 16/85, 50, 52, 54, 57, 84
See application file for complete search history.

(56) References Cited

U.S. PATENT DOCUMENTS

| | | | | | |
|---|---|---|---|---|---|
| 2,136,558 | A | * | 11/1938 | Manshel | 62/266 |
| 2,406,750 | A | * | 9/1946 | Dyett | 312/291 |
| 2,479,597 | A | * | 8/1949 | Anton | 16/86 A |
| 2,794,434 | A | * | 6/1957 | Evans | 126/200 |
| 3,218,111 | A | * | 11/1965 | Steiner | 312/405.1 |
| 3,243,928 | A | * | 4/1966 | Hare | 52/202 |
| 4,306,757 | A | * | 12/1981 | Horvay et al. | 312/292 |
| 4,586,347 | A | * | 5/1986 | McCarty | 62/265 |
| 4,660,871 | A | * | 4/1987 | Arakawa et al. | 292/81 |
| 4,828,236 | A | * | 5/1989 | Inoue | 267/182 |
| 5,209,082 | A | * | 5/1993 | Ha | 62/265 |
| 5,419,013 | A | * | 5/1995 | Hsiao | 16/319 |
| 5,924,782 | A | * | 7/1999 | Park | 312/328 |
| 6,055,823 | A | * | 5/2000 | Baker et al. | 62/265 |
| 6,336,252 | B1 | * | 1/2002 | Bando | 16/307 |
| 6,338,536 | B1 | * | 1/2002 | Ueno et al. | 312/405 |
| 6,682,161 | B1 | * | 1/2004 | Yun | 312/405 |
| 6,711,856 | B1 | * | 3/2004 | Hoffman | 49/386 |
| 2002/0062533 | A1 | * | 5/2002 | Huang | 16/50 |
| 2003/0132690 | A1 | * | 7/2003 | Shin et al. | 312/405 |
| 2004/0178710 | A1 | * | 9/2004 | Kim et al. | 312/405 |

FOREIGN PATENT DOCUMENTS

| | | | |
|---|---|---|---|
| JP | 05288459 | * | 2/1993 |
| KR | 20-267213 | | 12/2001 |

* cited by examiner

OTHER PUBLICATIONS

Publication KR2004046105A; Jung inventor; Fig and abstract*

*Primary Examiner*—Janet M. Wilkens
(74) *Attorney, Agent, or Firm*—Staas & Halsey LLP

(57) ABSTRACT

A refrigerator with a home bar door is smoothly and automatically opened and includes an automatic opening unit, a hook unit, a latch unit, and a damping unit. The automatic opening unit pushes the home bar door to a predetermined angle, so that the home bar door is automatically opened by gravity. The hook unit cooperates with the latch unit to lock or unlock the home bar door. The damping unit includes a casing and is connected to at least one hinge shaft. The automatic opening unit is provided with a push rod and an elastic member to open by a rotation thereof. The home bar door is rotated to be opened. A rotary member is rotatably installed in the casing, with oil contained therein to reduce rotating speed of the rotary member. An associated hinge shaft engages with the rotary member to rotate along with the rotary member.

31 Claims, 8 Drawing Sheets

REFRIGERATOR

CROSS-REFERENCE TO RELATED APPLICATION

This application claims the benefit of Korean Application No. 2002-74404, filed Nov. 27, 2002, in the Korean Intellectual Property Office, the disclosure of which is incorporated herein by reference.

BACKGROUND OF THE INVENTION

1. Field of the Invention

The present invention relates, in general, to refrigerators and, more particularly, to a refrigerator which has a home bar and is designed to automatically and smoothly open a home bar door to open or close the home bar provided in a door of a refrigerator compartment.

2. Description of the Related Art

As is well known to those skilled in the art, a refrigerator is an electrical appliance which supplies cool air of low temperature into a freezer compartment and a refrigerator compartment, thus keeping various kinds of food fresh. The freezer compartment stores the food which must be stored below a freezing temperature, such as meat and ice cream. The refrigerator compartment stores food which must be stored at a temperature slightly higher than the freezing temperature, such as vegetables and beverages.

Recently, a large-capacity refrigerator has been marketed and widely used which stores a large quantity of food, thus increasing convenience of use for users. The large-capacity refrigerator has a side-by-side structure. That is, the freezer compartment is provided on the left side of the refrigerator while the refrigerator compartment is provided on the right side of the refrigerator.

Further, a refrigerator has been marketed such that a water dispenser is provided on a door of the freezer compartment and a home bar is provided on a door of the refrigerator compartment, thus increasing convenience for the users, preventing cool air from escaping out of the refrigerator and preventing external air from flowing into the refrigerator due to frequent opening and closing of the doors of the freezer and refrigerator compartments.

The home bar is provided in the door of the refrigerator compartment to store the food which is used frequently, such as a beverage, e.g., wine and/or beer. The home bar is designed to have a storage chamber, thus allowing a user to conveniently access a bottle stored in the storage chamber without the necessity of opening the door of the refrigerator compartment. A home bar door is mounted to the door of the refrigerator compartment to open or close the home bar.

Generally, the home bar door is provided on an outer surface of the door of the refrigerator compartment, and covers an opening formed in the door of the refrigerator compartment to communicate with the home bar. In this case, the home bar door is hinged, at sides of a lower end thereof, to respective corners of a lower edge of the opening. Two folding connecting arms are mounted to the sides of the home bar door so as to allow the home bar door to be folded or unfolded. The arms connect the home bar door to side edges of the opening formed in the door of the refrigerator compartment, thus allowing the home bar door to be folded or unfolded to close or to open the opening.

The folding connecting arms, connecting the home bar door to the side edges of the opening of the door of the refrigerator compartment, are rotatably hinged. Two links of each of the folding connecting arms are connected to each other by a coil spring, so that the two links are folded by an elastic force of the coil spring. Thus, a rotating force is applied to the home bar door by the coil springs of the folding connecting arms in a direction of closing the opening of the door of the refrigerator compartment.

However, the conventional refrigerator having the home bar door constructed in this way has a problem that the home bar door is designed to be opened or closed by stretching or folding the folding connecting arms, so the home bar door is not automatically opened but manually opened, thus being inconvenient to use.

Further, the conventional refrigerator having the home bar has another problem that a force of a predetermined magnitude must be applied to the home bar door to overcome a spring force of the coil springs when opening the home bar door, and the home bar door collides with the opening of the door of the refrigerator compartment due to a restoring force of the coil springs when closing the home bar door, so a noise may be undesirably generated.

The conventional refrigerator has a further problem that the folding connecting arms and the coil springs are exposed to an outside when the home bar door is opened, thus degrading an appearance of the refrigerator, therefore reducing the appeal of the refrigerator to consumers.

SUMMARY OF THE INVENTION

Accordingly, it is an aspect of the present invention to provide a refrigerator which is designed to automatically open a home bar door by a simple structure.

It is another aspect to provide a refrigerator which is designed such that the home bar door is smoothly opened and closed, thus preventing noise from being generated.

It is a further aspect to provide a refrigerator which is designed such that components to open the home bar door are minimally exposed to an outside when opening the home bar door, thus having an attractive appearance.

Additional aspects and/or advantages of the invention will be set forth in part in the description which follows and, in part, will be obvious from the description, or may be learned by practice of the invention.

The above and/or other aspects of the present invention are achieved by providing a refrigerator, including a door of a refrigerator compartment, an opening formed at a front of the door, a home bar provided in the opening so as to have a storage chamber, a home bar door provided at the opening to open or close the home bar, and an automatic opening unit installed at an edge of the opening and pushing the home bar door at a predetermined angle so that the home bar door is automatically opened by gravity.

Two hinge shafts are mounted to respective sides of a lower end of the home bar door, and two shaft holes are provided at respective sides of a lower edge of the opening to receive the two hinge shafts, whereby the home bar door is upwardly or downwardly rotated with the two hinge shafts rotated in the two respective shaft holes.

The automatic opening unit includes a push rod projected forwardly from the lower edge of the opening, and an elastic member arranged behind the push rod to move the push rod in a forward direction or in a rearward direction, whereby the home bar door is rotated to be opened when the push rod is pushed in a forward direction by the elastic member.

A hook unit is inwardly mounted to an upper portion of the home bar door so as to project toward the opening, and a latch unit is inwardly mounted to an upper edge of the opening at a position corresponding to the hook unit, whereby the hook unit engages with or disengages from the latch unit so that the home bar door closes or opens the opening.

The latch unit includes a slide unit engaging with the hook unit, and an elastic member arranged behind the slide unit to move the slide unit in the forward direction or in the rearward direction, whereby the slide unit compresses the elastic member and simultaneously engages with the hook unit when the hook unit pushes the slide unit upon closure of the home bar door, and the slide unit is pushed in the forward direction along with the hook unit by the elastic member and simultaneously disengages from the hook unit when the upper portion of the closed home bar door is pushed, thus opening the home bar door.

Further, a damping unit is mounted to at least one position on a lower portion of the home bar door to reduce rotating speed of hinge shafts when the home bar door is opened, thus allowing the home bar door to be slowly opened.

The damping unit has a shape of a sealed box, and an end of one of the hinge shafts is connected to the damping unit, thereby reducing the rotating speed of the hinge shaft connected to the damping unit when the home bar door is opened.

The damping unit includes a box-shaped casing, a rotary member rotatably installed in the casing such that an end of the rotary member is outwardly projected from the casing, with a liquid (e.g., oil) contained in the casing to reduce rotating speed of the rotary member, and the hinge shaft engaging with the rotary member to rotate along with the rotary member.

Further, a lighting switch is mounted to an edge of the opening opposed to the edge of the opening to which the automatic opening unit is mounted, the lighting switch being turned on or turned off when the home bar door is respectively opened or closed, thus turning on or turning off a lighting unit which is installed in the home bar.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
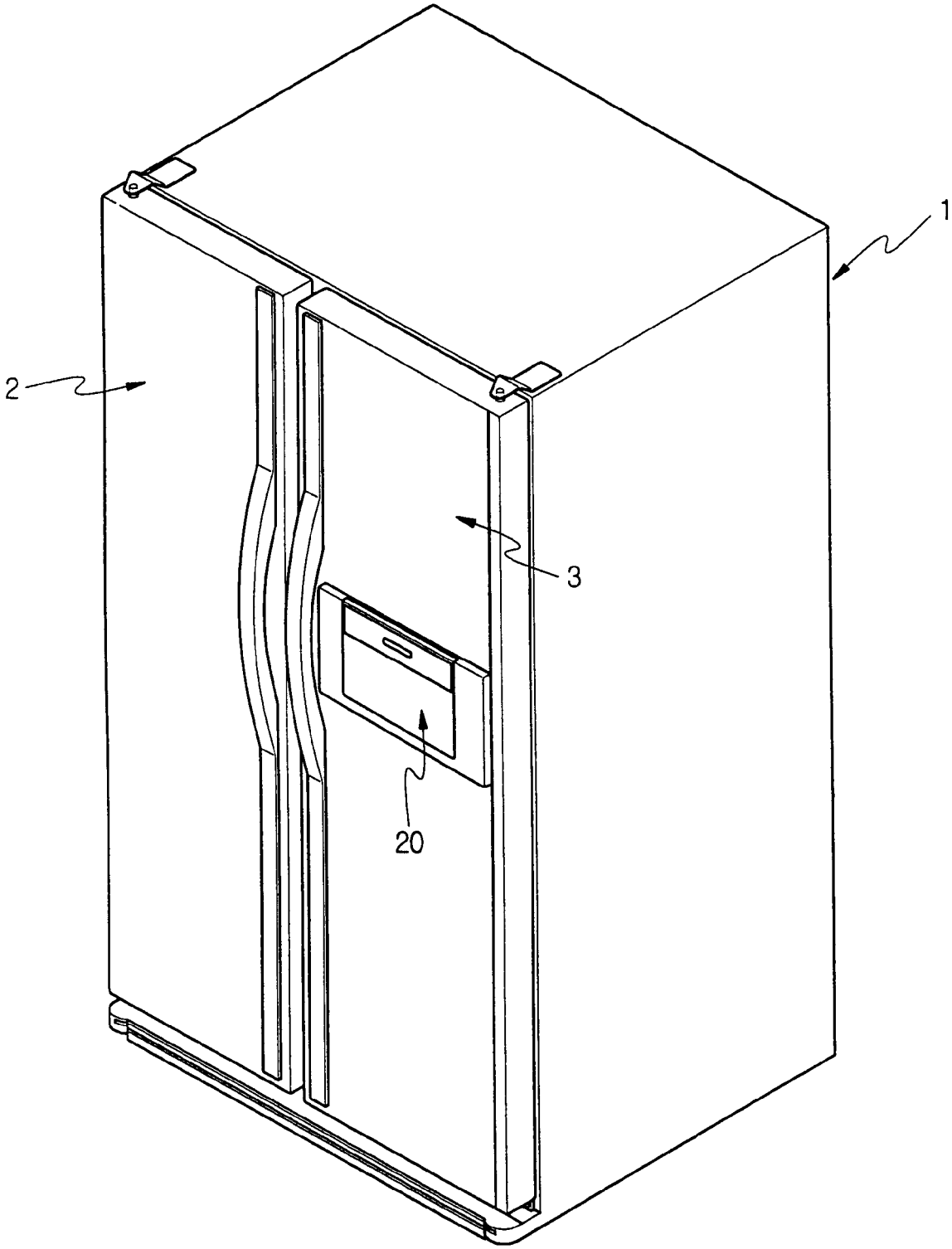
FIG. 1 is a perspective view illustrating a refrigerator according to an embodiment of the present invention.

Reference will now be made in detail to the present preferred embodiment of the present invention, examples of which are illustrated in the accompanying drawings, wherein like reference numerals refer to like elements throughout.

FIG. 1 illustrates a refrigerator having a home bar door according to an embodiment of the present invention. As illustrated in FIG. 1, the refrigerator includes a cabinet 1. The cabinet 1 is opened at a front, and is partitioned into a freezer compartment and a refrigerator compartment. A door of the freezer compartment 2 is mounted to the front of the cabinet 1 at one side to open or to close the freezer compartment, and a refrigerator door 3 of the refrigerator compartment is mounted to the front of the cabinet 1 at a remaining side to open or to close the refrigerator compartment. A home bar 10 (see FIG. 2) is provided in the refrigerator door 3 of the refrigerator compartment so as to have a storage chamber therein. A home bar door 20 is mounted to the front of the home bar 10 to open or to close the home bar 10. Such a construction allows a bottled beverage, such as wine or whisky, to be conveniently taken out from and put into the home bar 10 through the home bar door 20 which is relatively smaller than the refrigerator door 3 of the refrigerator compartment, without a necessity of opening the refrigerator door 3 of the refrigerator compartment.

Figure 2:
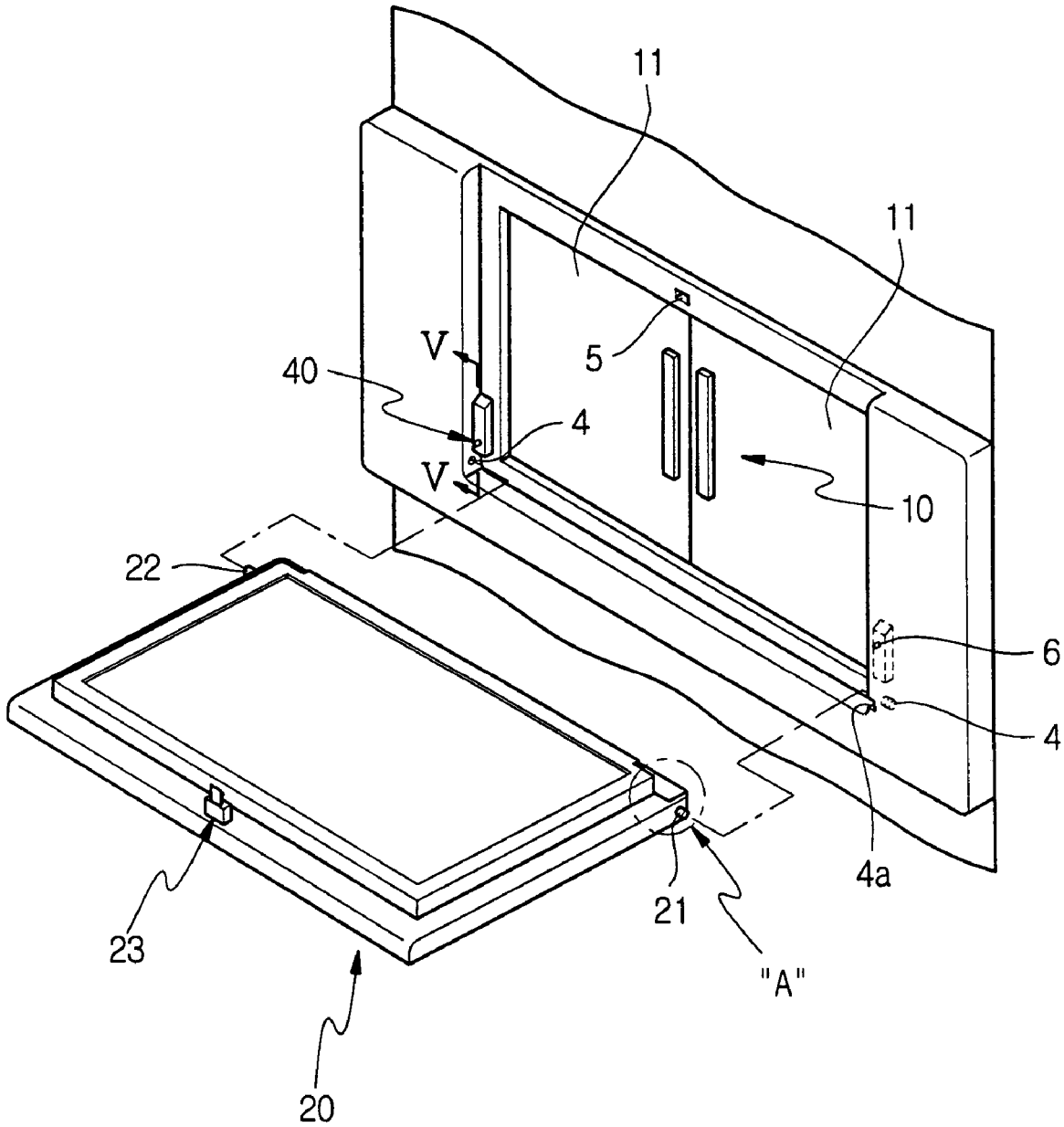
FIG. 2 is a perspective view of a part of the refrigerator, with a home bar door illustrated in FIG. 1 being removed from a door of a refrigerator compartment.

FIG. 2 is a perspective view of a part of the refrigerator, with the home bar door 20 illustrated in FIG. 1 being removed from the refrigerator door 3 of the refrigerator compartment. As illustrated in FIG. 2, an opening 3*a* (see FIG. 8) is formed at a front of the refrigerator door 3 of the refrigerator compartment to communicate with the home bar 10. Further, the home bar 10 is doubly closed by a pair of sliding doors 11, as well as the home bar door 20, thus substantially preventing cool air from escaping through the opening 3*a*. In this case, the pair of sliding doors 11 slides in a horizontal direction.

The home bar door 20 has a size corresponding to the opening 3*a*, and is provided on a lower end of the home bar door 20 with first and second hinge shafts 21 and 22. The first and second hinge shafts 21 and 22 are fitted into respective shaft holes 4 which are provided at opposite sides of a lower edge of the opening 3*a*. A hook unit 23, which projects inwardly toward the refrigerator compartment, is mounted to an upper portion of the home bar door 20. The hook unit 23 engages with or disengages from a latch unit 30 (see FIG. 6) which is installed inside an insertion hole 5 formed at an upper edge of the opening 3*a*, so that the home bar door 20 selectively closes or opens the opening 3*a*.

An automatic opening unit 40 is installed at one side edge of the opening 3*a* to push the home bar door 20 forward at a predetermined angle θ (see FIG. 5) so that the home bar door 20 is further (i.e., automatically) opened by gravity. A lighting switch 6 is mounted to a remaining side edge of the opening 3*a* to turn on or to turn off when the home bar door 20 is opened or closed, thus turning on or turning off a lighting unit (not shown) which is installed in the home bar 10.

According to the embodiment of the present invention illustrated in the drawings, the automatic opening unit 40 and the lighting switch 6 are installed at the one side edge and the remaining side edge of the opening 3*a*, respectively. However, without being limited to such an arrangement, the automatic opening unit 40 may be installed at any edge of the opening 3*a* while the lighting switch 6 may be installed at any other edge of the opening 3*a*.

Further, a damping unit 50 (see FIG. 3) is installed in a lower portion. The damping unit 50 is connected to the hinge shaft 21 to reduce an opening (rotating) speed of the home bar door 20 and allowing the home bar door 20 to smoothly open.

The damping unit 50 illustrated in the drawings is connected to the hinge shaft 21 which is mounted to the right side of the home bar door 20. However, the damping unit 50 may be connected to the hinge shaft 22 which is mounted to the left side of the home bar door 20 to reduce an opening (rotating) speed of the hinge shaft 22. Alternatively, two damping units 50 may be connected to the hinge shafts 21 and 22, respectively, to reduce the opening (rotating) speed of the hinge shafts 21 and 22.

That is, the hook unit 23 cooperates with the latch unit 30 so that the home bar door 20 selectively opens or closes the opening 3*a* of the refrigerator door 3 of the refrigerator compartment. The automatic opening unit 40 operates to automatically open the home bar door 20. Further, the damping unit 50 operates to ensure a smooth opening of the home bar door 20. The configuration and operation of the above-mentioned components will be described in the following in detail.

Figure 3:
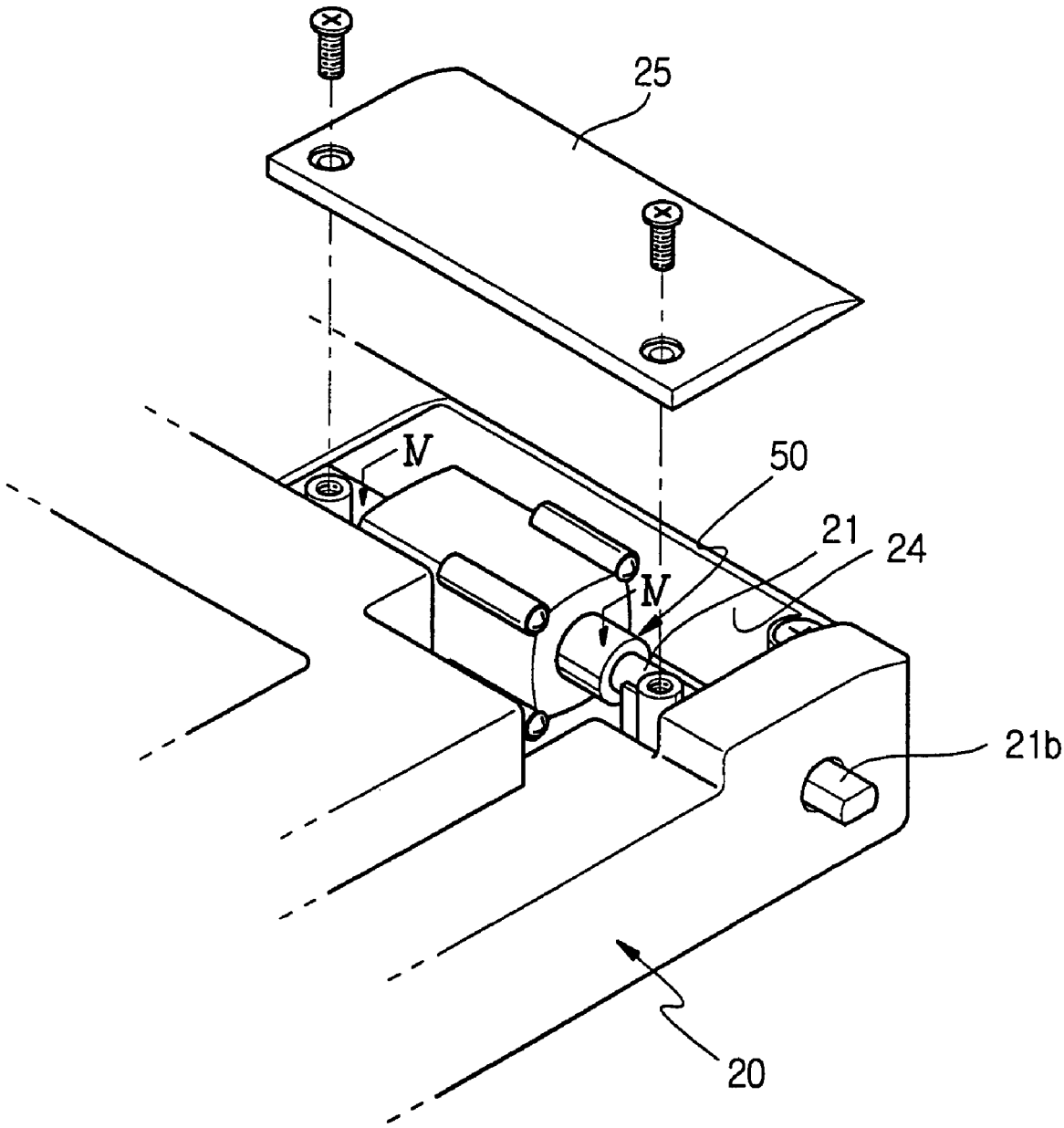
FIG. 3 is an exploded perspective view of a part of the home bar door of the refrigerator, in which a damping unit installed at area "A" of FIG. 2 is illustrated.
Figure 4:
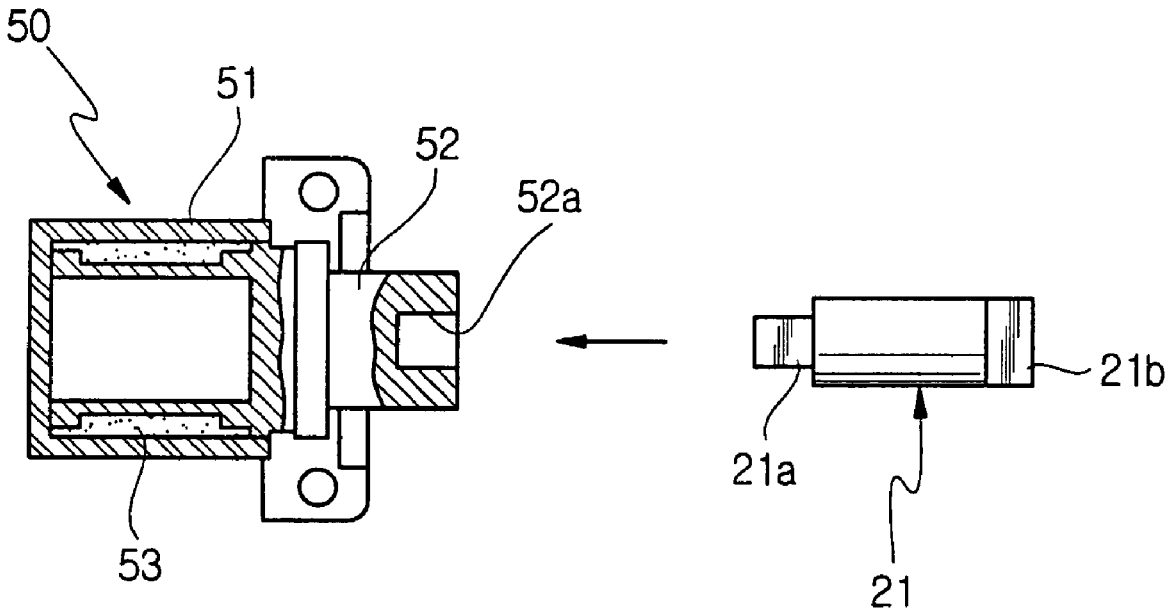
FIG. 4 is an exploded partial sectional view of the damping unit taken along the line IV—IV of FIG. 3.

FIG. 3 illustrates the damping unit installed at the area "A" of FIG. 2. FIG. 4 is an exploded partial sectional view taken along the line IV—IV of FIG. 3. As illustrated in FIG. 3, the damping unit 50 is installed in a mounting hole 24 which is provided in the lower portion of the home bar door 20, and the mounting hole 24 is covered with a cover 25. A first end 21*a* (see FIG. 4) of the hinge shaft 21 is connected to the right side of the damping unit 50, thus reducing the opening (rotating) speed of the hinge shaft 21. A second end 21*b* of the hinge shaft 21 is cut at an upper and lower portions thereof to flatten the second end 21*b*, and is outwardly projected from the home bar door 20. The second end 21*b* of the hinge shaft 21 is rotatably fitted into the shaft hole 4 through a notch 4*a* (see FIG. 2) which is formed at the refrigerator door 3 of the refrigerator compartment.

As illustrated in FIG. 4, the damping unit 50 includes a casing 51 in a shape of a box which is opened at one side thereof. A rotary member 52 is rotatably installed in the casing 51 so as to project at an end from the open side of the casing 51. In this case, oil 53 is contained in the casing 51 to reduce a rotating speed of the rotary member 52.

The end of the rotary member 52, which is outwardly projected from the casing 51, is provided with an insertion hole 52*a*, so that the first end 21*a* of the hinge shaft 21 is inserted into the insertion hole 52*a*. The insertion hole 52*a* and the first end 21*a* of the hinge shaft 21 have a common cross-section, for example, a rectangular cross-section, so that the rotary member 52 is rotated along with the hinge shaft 21.

Although not illustrated in the drawings in detail, the hinge shaft 22, which is installed at the lower end of the left side of the home bar door 20 to fit the home bar door 20 into the shaft hole 4 or remove the home bar door 20 from the shaft hole 4, is movably installed in the home bar door 20 in a horizontal direction. Thus, when one desires to install the home bar door 20 at the refrigerator door 3 of the refrigerator compartment, the hinge shaft 21 is primarily fitted into the corresponding shaft hole 4 through the notch 4*a*. Next, the hinge shaft 22 is slightly pushed into the home bar door 20 to fit into the corresponding shaft hole 4. Further, when one desires to remove the home bar door 20 from the refrigerator door 3 of the refrigerator compartment, the hinge shaft 22 is primarily pushed into the home bar door 20 to remove the hinge shaft 22 from the corresponding shaft hole 4. Thereafter, the hinge shaft 21 is removed from the shaft hole 4, and is pulled out through the notch 4*a*. At this time, the home bar door 20 is removed from the refrigerator door 3 of the refrigerator compartment.

Figure 5:
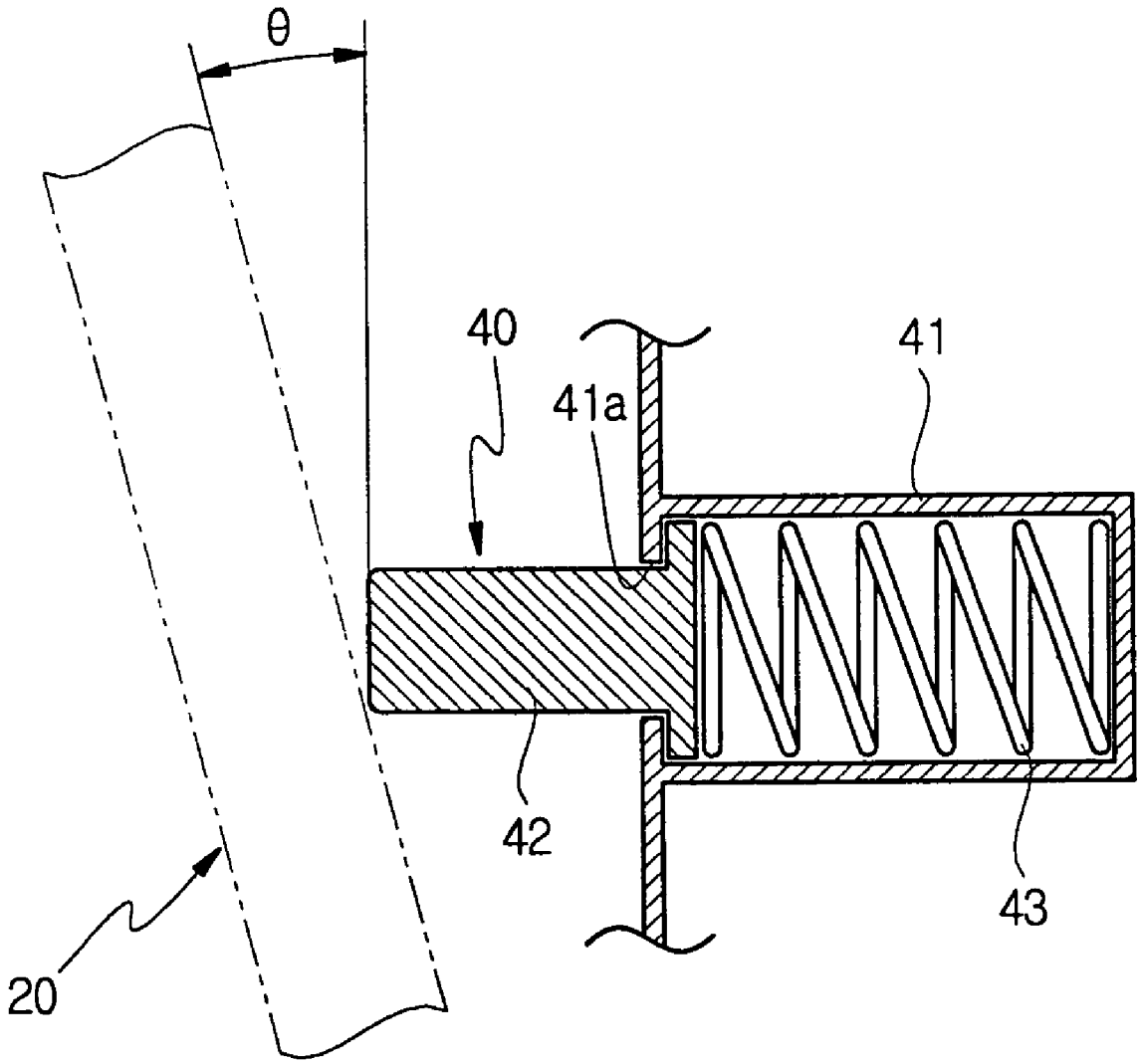
FIG. 5 is a partial sectional view taken along the line V—V of FIG. 2 for illustrating the structure of an automatic opening unit which operates to push the home bar door to a predetermined position, thus automatically opening the home bar door.

FIG. 5 illustrates the structure of the automatic opening unit 40 which operates to push the home bar door to a predetermined angle θ, thus automatically opening the home bar door. As illustrated in FIG. 5, the automatic opening unit 40 includes a box-shaped casing 41, a push rod 42, and an elastic member 43. The box-shaped casing 41 is provided at the left edge of the opening 3*a* of the refrigerator door 3 of the refrigerator compartment and is provided at a front of the box-shaped casing 41 with a hole 41*a*. The push rod 42 is installed in the box-shaped casing 41 so as to project in a forward direction away from the box-shaped casing 41 through the hole 41*a* which is formed at the front of the box-shaped casing 41. The elastic member 43 is provided in the box-shaped casing 41 behind the push rod 42, and elastically pushes the push rod 42 so that the push rod 42 projects in the forward direction away from the box-shaped casing 41. The elastic member 43 may comprise a coil spring or any other kind of spring which elastically pushes the push rod 42 in the forward direction.

Thus, when the home bar door 20 is unlocked, the push rod 42 is moved in the forward direction by an elastic force of the elastic member 43 to push the home bar door 20 in the forward direction, so that the home bar door 20 is opened at the predetermined angle θ. The home bar door 20, opened at the predetermined angle θ, is further automatically opened by gravity. That is, the home bar door 20 is opened in a downward direction by gravity while the opening (rotating) speed is controlled by the damping unit 50.

Figure 6:
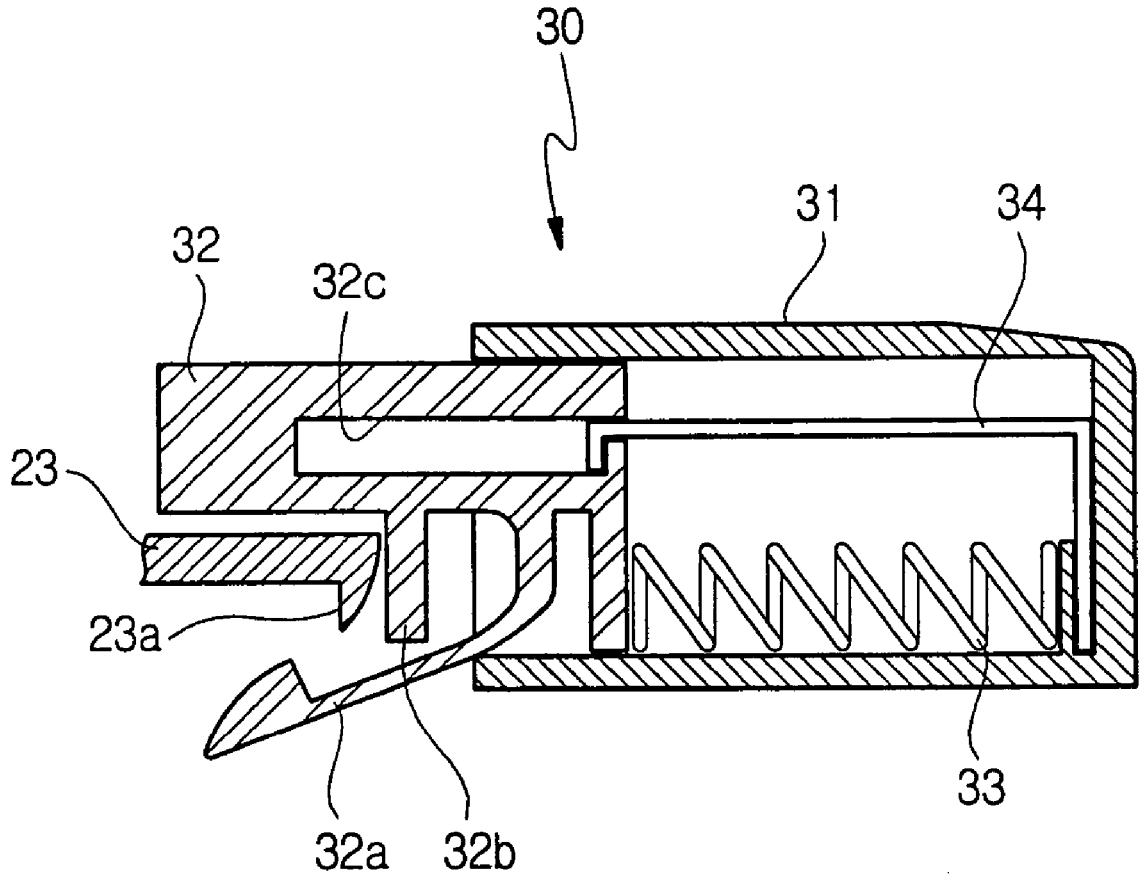
FIG. 6 is a sectional view illustrating a state where a hook unit of the home bar door according to the embodiment of the present invention is released from a latch unit of the door of the refrigerator compartment.
Figure 7:
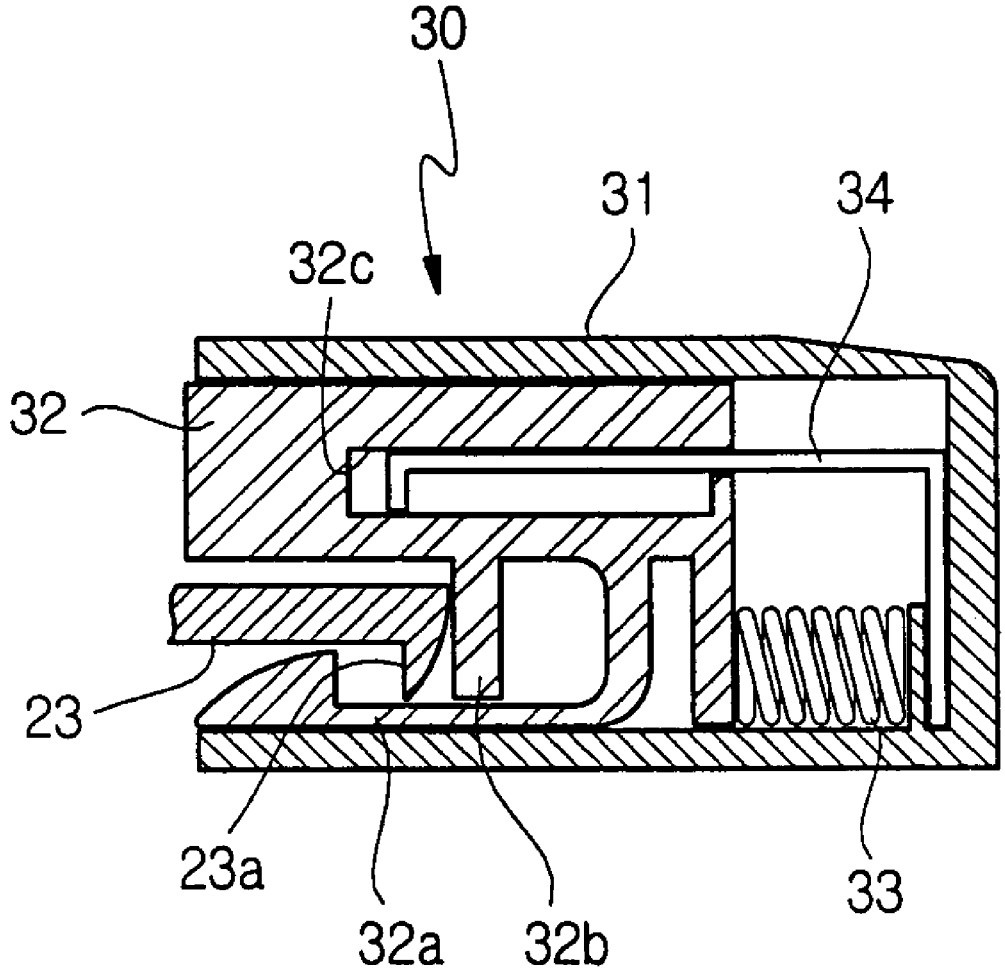
FIG. 7 is a view corresponding to FIG. 6, but illustrating the hook unit of the home bar door brought into engagement with the latch unit of the door of the refrigerator compartment.

FIG. 6 illustrates a state where the hook unit of the home bar door is released from the latch unit of the refrigerator door 3 of the refrigerator compartment. FIG. 7 is a view illustrating a state where the hook unit engages with the latch unit so that the opening is closed by the home bar door.

As illustrated in FIG. 6, the latch unit 30 is installed inside the insertion hole 5, which is formed at the upper edge of the opening 3*a* of the refrigerator door 3 of the refrigerator compartment, and includes a casing 31 which is opened at a front. A slide unit 32 is slidably moved into and out of the casing 31 through the open front thereof. An elastic member 33 is provided in the casing 31 behind the slide unit 32, and operates to elastically push the slide unit 32 in a forward direction away from the casing 31. The elastic member 33 may comprise a coil spring or any other kind of spring which elastically pushes the slide unit 32 in the forward direction.

Further, a stopper 34 is installed in the casing 31 such that a first end of the stopper 34 is fixed to a rear end of the casing 31 and a second end of the stopper 34 is fitted into a guide hole 32*c* which is formed in the slide unit 32 so as to prevent the slide unit 32 from being unexpectedly removed from the casing 31.

The slide unit 32 includes a locking projection 32*a*, a vertical projection 32*b*, and the guide hole 32*c*. The locking projection 32*a* forwardly extends from the lower end of the slide unit 32. The vertical projection 32*b* projects in a downward direction at a position in front of the locking projection 32*a*. The guide hole 32*c* is formed in the slide unit 32 to receive the second end of the stopper 34. The locking projection 32*a* is thin enough in a thickness thereof to be flexible, so that the locking projection 32*a* is folded and is inserted into the casing 31 when the slide unit 32 is slidably moved into the casing 31. Further, a locking hook 23*a* extends in a downward direction from an end of the hook unit 23 which is mounted to the home bar door 20.

Thus, when the hook unit 23 mounted to the home bar door 20 pushes the vertical projection 32*b*, the elastic member 33 is compressed and the locking projection 32*a* is folded. Thus, the slide unit 32 slides in the casing 31, so that the locking hook 23*a* of the hook unit 23 comes into contact with the vertical projection 32*b* of the slide unit 32 as shown in FIG. 7, to lock the home bar door 20. That is, the tension of the folded locking projection 32*a* against the casing 31 keeps the elastic member 33 compressed to lock the home bar door 20.

When the upper portion of the home bar door 20 is slightly and instantaneously pushed and is then released, the hook unit 23 pushes the vertical projection 32*b* in a rearward direction. At this time, the elastic member 33 is compressed. By the restoring force of the elastic member 33, which is compressed, the locking hook 23*a* of the hook unit 23 pulls in the forward direction the locking projection 32*a* of the slide unit 32 so that the locking projection 32*a* slides out of the casing 31. Thus, the hook unit 23 is disengaged from the latch unit 30. Simultaneously, the home bar door 20 is opened by the operation of the automatic opening unit 40.

Figure 8:
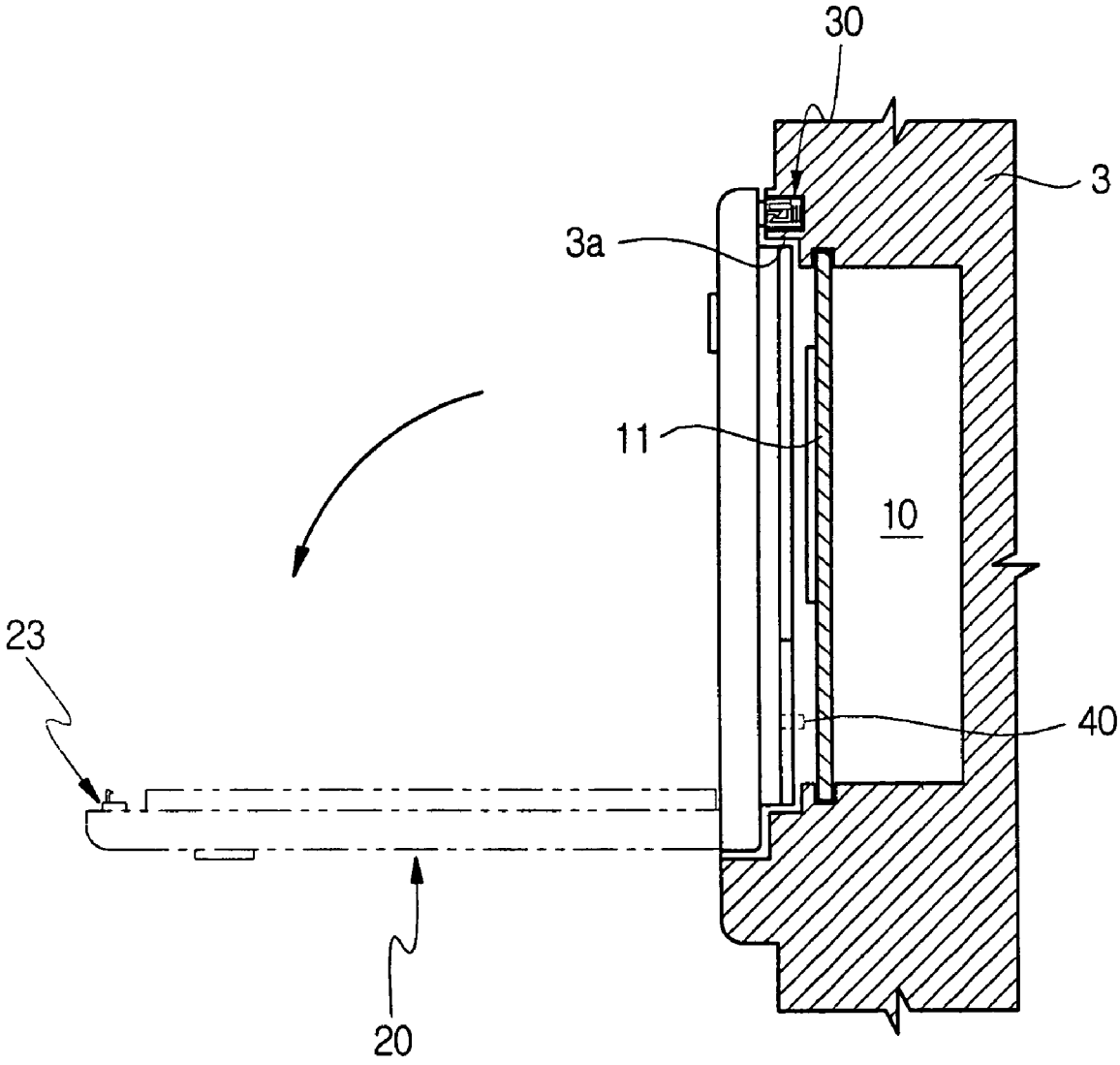
FIG. 8 is a partial sectional view corresponding to FIG. 2 illustrating the refrigerator, when the home bar door is opened or closed.

The operation of opening or closing the home bar door will be described in the following with reference to FIGS. 1 to 8. FIG. 8 shows the refrigerator according to the embodiment of the present invention, when the home bar door is open or closed.

When the upper portion of the home bar door 20, which is in close contact with the opening 3*a* of the refrigerator door 3 of the refrigerator compartment to close the opening 3*a*, is instantaneously pushed and then released, the elastic member 33 of the latch unit 30 is instantaneously and further compressed in comparison with the state illustrated in FIG. 7. At this time, an elastic force of the elastic member 33 is applied in the forward direction, thus pushing the slide unit 32 and the hook unit 23 in the forward direction. At this time, the locking hook 23*a* of the hook unit 23 engages with the locking projection 32*a* of the slide unit 32, thus making the slide unit 23 slidably move in the forward direction. Therefore, the hook unit 23 is disengaged from the latch unit 30.

Simultaneously, as shown in FIG. 5, the push rod 42 of the automatic opening unit 40 is moved in the forward direction by the elastic member 43, so the home bar door 20 is opened at the predetermined angle θ. When the home bar door 20 is opened at the predetermined angle θby the automatic opening unit 40, the home bar door 20 is rotated in the downward direction around the hinge shafts 21 and 22 by gravity, thus being automatically opened. At this time, as shown in FIGS. 3 and 4, the rotary member 52 of the damping unit 50 engaging with the hinge shaft 21 rotates the hinge shaft 21. In this case, the rotary member 52 is subject to a rotating resistance provided by the oil 53, so the rotating speed of the hinge shaft 21 is reduced, thus the home bar door 20 is smoothly and slowly rotated to be perpendicular to a front surface of the refrigerator door 3 of the refrigerator compartment.

When closing the home bar 10 is desired, the home bar door 20 is rotated in an upward direction around the hinge shafts 21 and 22, as illustrated in FIG. 5. In such a state, when the home bar door 20 is further rotated, the push rod 42 and the elastic member 43 of the automatic opening unit 40 are moved in the rearward direction so that the push rod 42 and elastic member 43 of the automatic opening unit 40 are retracted into the box-shaped casing 41. Simultaneously, the locking hook 23*a* of the hook unit 23 pushes the vertical projection 32*b* of the slide unit 32 so that the elastic member 33 in the latching unit 30 is compressed and the slide unit 32 is retracted into the casing 31, thus the home bar door 20 is locked.

As is apparent from the above description, a refrigerator is provided such that a home bar door is automatically opened by an automatic opening unit having a simple configuration, thus allowing a bottled beverage, such as wine or whisky, to be conveniently put into or taken out from a home bar, therefore being convenient to use.

Further a refrigerator is provided such that the home bar door is smoothly opened and closed by a damping unit so as to prevent vibration or noise from being generated, thus allowing a bottled beverage, such as wine, to be stably stored in the home bar and enhancing the satisfaction of consumers.

Further, a refrigerator is provided such that components to open the home bar door are minimally exposed to the outside, thus providing an attractive appearance.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A refrigerator, comprising:

a refrigerator compartment;

an opening formed at a front of a door;

a home bar provided in the opening so as to have a storage chamber disposed therein;

a home bar door provided at the opening to selectively open or close the home bar;

an automatic opening unit installed at an edge of the opening, and pushing the home bar door to a predetermined angle so that the home bar door is automatically opened by gravity;

one or more hinge shafts; and a damping unit mounted to at least one position on a lower portion of the home bar door to reduce a rotating speed of the one or more hinge shafts when the home bar door is being opened, allowing the home bar door to controllably open, wherein an end of a respective one of the one or more hinge shafts is connected to the damping unit, to reduce the rotating speed of the respective one of the hinge shafts connected to the damping unit when the home bar door is opened.

2. The refrigerator as set forth in claim 1, further comprising:

first and second hinge shafts mounted to opposite sides of a lower end of the home bar door; and first and second shaft holes provided at opposite sides of a lower edge of the opening to receive, respectively, the first and second hinge shafts, wherein the home bar door rotates with the first and second hinge shafts rotated in the first and second shaft holes, respectively.

3. The refrigerator as set forth in claim 2, wherein the automatic opening unit comprises:

a push rod projecting away from the refrigerator compartment from the edge of the opening; and an elastic member arranged adjacent to the push rod to move the push rod in a direction extending along the projected push rod, wherein the home bar door rotates in a forward direction to open, when the push rod is pushed in the forward direction by the elastic member.

4. The refrigerator as set forth in claim 3, further comprising:

a casing having a box shape which is opened at a front thereof, wherein the elastic member is set in the casing, and the push rod projects from the casing through the open front of the casing by the elastic member.

5. The refrigerator as set forth in claim 1, further comprising:

a hook unit mounted to an upper portion of the home bar door so as to project toward the opening; and a latch unit mounted to an upper edge of the opening at a position corresponding to the hook unit, wherein the hook unit engages with or disengages from the latch unit so that the home bar door selectively closes or opens the opening.

6. The refrigerator as set forth in claim 5, wherein the latch unit comprises:

a slide unit engaging with the hook unit; and an elastic member arranged adjacent to the slide unit to move the slide unit in a direction extending along a length of the slide unit, wherein the slide unit compresses the elastic member and simultaneously engages with the hook unit when the hook unit pushes the slide unit upon closure of the home bar door, and the slide unit is pushed along with the hook unit by the elastic member, which decompresses, and simultaneously disengages from the hook unit when the upper portion of the closed home bar door is pushed to open the home bar door.

7. The refrigerator as set forth in claim 6, wherein said elastic member comprises:

a coil spring.

8. The refrigerator as set forth in claim 1, further comprising:

a lighting unit installed in the home bar; and a lighting switch mounted to a second edge of the opening opposite to the edge of the opening to which the automatic opening unit is installed, said lighting switch turning on or turning off when the home bar door is opened or closed, respectively, to turn on or turn off the lighting unit.

9. The refrigerator as set forth in claim 1, wherein the damping unit has a sealed box shape.

10. A refrigerator, comprising:

a refrigerator compartment;

an opening formed at a front of the a door;

a home bar provided in the opening so as to have a storage chamber disposed therein;

a home bar door provided at the opening to selectively open or close the home bar;

an automatic opening unit installed at an edge of the opening, and pushing the home bar door to a predetermined angle so that the home bar door is automatically opened by gravity;

one or more hinge shafts; and a damping unit mounted to at least one position on a lower portion of the home bar door to reduce a rotating speed of the one or more hinge shafts when the home bar door is being opened, allowing the home bar door to controllably open, wherein an end of a respective one of the one or more hinge shafts is connected to the damping unit, to reduce the rotating speed of the respective one of the hinge shafts connected to the damping unit when the home bar door is opened, and wherein the damping unit comprises:

a box-shaped casing with a fluid disposed therein;

a rotary member rotatably installed in the box-shaped casing such that an end of the rotary member projects from the box-shaped casing with the fluid disposed in the box-shaped casing to reduce the rotating speed of the rotary member; and the hinge shaft engaging with the rotary member to rotate along with the rotary member.

11. The refrigerator as set forth in claim 10, wherein the damping unit has a sealed box shape.

12. A refrigerator with one or more compartments therein to cool food, comprising:

a door of a respective one of the compartments to selectively open and close the respective one of the compartments;

a home bar disposed in the door to provide a storage chamber therein;

a home bar door provided at a front of the home bar to selectively open or close the home bar;

an automatic opening unit provided in a vicinity of the home bar to push the home bar door to a position such that the home bar door is automatically opened by gravity;

one or more hinge shafts; and a damping unit to reduce a rotating speed of the one or more hinge shafts when the home bar door is being opened, allowing the home bar door to controllably open, wherein an end of a respective one of the one or more hinge shafts is connected to the damping unit, to reduce the rotating speed of the respective one of the hinge shafts connected to the damping unit when the home bar door is opened.

13. The refrigerator as set forth in claim 12, wherein the damping unit has a sealed box shape.

14. A refrigerator with one or more compartments therein to cool food with a door of a respective one of the compartments to selectively open and close the respective one of the compartments, comprising:

a storage unit disposed in the door to provide storage therein;

a storage door provided at a front of the storage unit to open or close the storage unit;

an opening unit provided in a vicinity of the storage unit to open the storage door by rotating the storage door to a position in which a gravitational force causes the storage door to move to a fully opened position;

one or more hinge shafts; and a damping unit to reduce a rotating speed of the one or more hinge shafts when the home bar door is being opened, allowing the home bar door to controllably open, wherein an end of a respective one of the one or more hinge shafts is connected to the damping unit, to reduce the rotating speed of the respective one of the hinge shafts connected to the damping unit when the home bar door is opened.

15. A refrigerator with one or more compartments therein to cool food with a door of a respective one of the compartments to selectively open and close the respective one of the compartments, comprising:

a storage unit disposed in the door to provide storage therein;

a storage door provided at a front of the storage unit to selectively open or close the storage unit;

an opening unit provided in a vicinity of the storage unit to move the storage door to a position such that the storage door is automatically opened by gravity;

one or more hinge shafts; and a damping unit mounted to at least one position on the storage door to dampen a rotation of the one or more hinge shafts when the storage door is opened to controllably open the storage door, wherein the damping unit mates with an end of one of the hinge shafts to reduce a rotating speed of the one hinge shaft mated to the damping unit when the storage door is opened.

16. The refrigerator as set forth in claim 15, further comprising:

one or more hinges mounted to a lower end of the storage door and an edge of the storage unit to rotate the storage door thereby.

17. The refrigerator as set forth in claim 16, wherein the opening unit comprises:

an expansion unit projectable toward the storage door from an edge of the storage door to rotate the storage door away from the refrigerator, when the storage door is not latched close.

18. The refrigerator as set forth in claim 17, wherein said expansion unit comprises:

a casing which is opened at a front thereof;

a push rod slidably set in the casing with a portion of the push rod projecting from the casing; and an elastic member disposed in the casing adjacent to the push rod to bias the push rod to a fully extended position.

19. The refrigerator as set forth in claim 15, further comprising:

a latch unit mounted to upper portions of the storage unit and the storage door at positions corresponding to each other such that the storage door is latchable when in a closed position adjacent to the door of the refrigerator.

20. The refrigerator as set forth in claim 19, wherein the latch unit further comprises:

a latch member disposed at the upper portion of the storage unit; and a hook unit disposed at the upper portion of the storage door so as to engage with or disengage from the latch member to selectively close or open the storage unit.

21. The refrigerator as set forth in claim 20, wherein said latch member comprises:

a casing thereof;

a slide unit slidably disposed at the casing with a portion of the push rod projecting from the casing and engagable with the hook unit; and an elastic member disposed in the casing adjacent to the slide unit to bias the slide unit to project from the casing such that the slide unit compresses the elastic member and simultaneously engages with the hook unit when the hook unit moves the slide unit upon closure of the storage door, and the slide unit is projected from the casing and moves along with the hook unit by the elastic member to disengage from the hook unit when the upper portion of the closed storage door is pushed.

22. The refrigerator as set forth in claim 21, wherein the elastic member comprises:

a coil spring.

23. The refrigerator as set forth in claim 15, wherein:

the one or more hinge shafts are plural hinge shafts; and the damping unit is plural discrete damping units mounted to positions on the storage door to reduce a rotating speed of corresponding ones of the plural hinge shafts when the storage door is opened.

24. The refrigerator as set forth in claim 15, wherein the damping unit comprises:

a box-shaped casing;

a rotary member rotatable in the casing such that an end of the rotary member projects from the casing;

a damping member provided in the casing adjacent to the rotating member to reduce a rotating speed of the rotary member; and the hinge shaft mating with the rotary member to rotate along with the rotary member.

25. The refrigerator as set forth in claim 24, wherein the damping member is a damping fluid disposed around the rotary member.

26. The refrigerator as set forth in claim 25, wherein the damping member is oil.

27. The refrigerator as set forth in claim 15, wherein the opening unit is substantially prevented from being exposed to an exterior of the refrigerator by the storage door.

28. The refrigerator as set forth in claim 15, wherein the storage unit has a volume smaller than that of the refrigerator compartment with access provided to the storage unit by the storage door without opening the door to the refrigerator.

29. The refrigerator as set forth in claim 15, further comprising:

a lighting unit disposed in the storage unit; and a lighting switch disposed such that the lighting switch is turned on or turned off when the storage door is opened or closed, respectively, to turn on or turn off the lighting unit.

30. The refrigerator as set forth in claim 15, wherein the damping unit is sealed.

31. A refrigerator with one or more compartments therein to cool food with a door of a respective one of the compartments to selectively open and close the respective one of the compartments, comprising:

a storage unit disposed in the door to provide storage therein;

a storage door provided at a front of the storage unit to selectively open or close the storage door;

an opening unit provided in a vicinity of the storage unit to move a home bar door to a position such that the storage door is automatically opened by gravity;

one or more hinge shafts; and a damping unit mounted to at least one position on the storage door to dampen a rotation of the one or more hinge shafts when the storage door is opened to controllably open the storage door, wherein the one or more hinge shafts and the damping unit have a common cross-section such that a rotary member rotates along with the one or more hinge shafts.

* * * * *

UNITED STATES PATENT AND TRADEMARK OFFICE

CERTIFICATE OF CORRECTION

PATENT NO. : 7,059,693 B2
APPLICATION NO. : 10/626622
DATED : June 13, 2006
INVENTOR(S) : Yong-Pil Park It is certified that error appears in the above-identified patent and that said Letters Patent is hereby corrected as shown below:

On Title Page item 73
First Page Column 1 (Name of Assignee), Line 1, change “LTD,” to --LTD.,--.

On Title Page item 56
First Page Column 2 (OtherPublications), Line 1, change “Fig” to --Fig.--.

On Title Page item 56
First Page Column 2 (Other Publications), Line 2, change “abstract” to --abstract.--.

Column 9, line 50, after “of” delete “the”.

Signed and Sealed this

Fifth Day of December, 2006

JON W. DUDAS
*Director of the United States Patent and Trademark Office*